US007641471B2

(12) United States Patent
Chung

(10) Patent No.: US 7,641,471 B2
(45) Date of Patent: Jan. 5, 2010

(54) PIEZOELECTRIC LIGHTER WITH INCREASED SECURITY

(75) Inventor: Aman Kai Man Chung, Shatin (HK)

(73) Assignee: Polyconcept Holding, Sucy en Brie (FR)

( * ) Notice: Subject to any disclaimer, the term of this patent is extended or adjusted under 35 U.S.C. 154(b) by 481 days.

(21) Appl. No.: 10/541,674

(22) PCT Filed: Jan. 9, 2004

(86) PCT No.: PCT/FR2004/000035

§ 371 (c)(1),
(2), (4) Date: Mar. 10, 2006

(87) PCT Pub. No.: WO2004/070274

PCT Pub. Date: Aug. 19, 2004

(65) Prior Publication Data

US 2006/0147858 A1 Jul. 6, 2006

(30) Foreign Application Priority Data

Jan. 9, 2003 (FR) ..... 03 00190

(51) Int. Cl.
*F23D 11/36* (2006.01)
*F23Q 7/12* (2006.01)

(52) U.S. Cl. ..... 431/153; 431/255

(58) Field of Classification Search ..... 431/153, 431/255, 344, 345, 132, 29
See application file for complete search history.

(56) References Cited

U.S. PATENT DOCUMENTS

| | | | | |
|---|---|---|---|---|
| 6,039,561 | A * | 3/2000 | Lei | 431/153 |
| 6,135,761 | A * | 10/2000 | Chen | 431/132 |
| 6,478,575 | B2 * | 11/2002 | Sher | 431/153 |
| 6,939,128 | B2 * | 9/2005 | Suzuki et al. | 431/130 |
| 2002/0110768 | A1 | 8/2002 | Sher | |
| 2002/0115031 | A1 * | 8/2002 | Chen | 431/153 |
| 2002/0132201 | A1 * | 9/2002 | Zhang | 431/153 |
| 2003/0013058 | A1 * | 1/2003 | Sher | 431/153 |

FOREIGN PATENT DOCUMENTS

| | | |
|---|---|---|
| FR | 2 804 749 | 8/2001 |
| WO | WO 99/46539 | 9/1999 |

* cited by examiner

*Primary Examiner*—Kenneth B Rinehart
*Assistant Examiner*—Daniel A Bernstein
(74) *Attorney, Agent, or Firm*—Young & Thompson

(57) ABSTRACT

A piezoelectric type of lighter, with a flame generation device (30), including a gas jet release mechanism (36) and a piezoelectric mechanism for generation of a spark (50), characterized in that the lighter includes two actuators (32, 34) which are displaced following a pivoting movement under the action of a force applied by a user, between a first position called rest position and a second position called the active position, whereby at least one of the actuators, called the first actuator, can be displaced independently of the second actuator and acts on at least one of the mechanisms, called the first mechanism. The lighter can produce a flame from the lighter when the two actuators have been pivoted.

17 Claims, 2 Drawing Sheets

PIEZOELECTRIC LIGHTER WITH INCREASED SECURITY

This is a 371 National Stage application of International application no. PCT/FR2004/00035, filed Jan. 9, 2004, which claims priority to French application no. 0300190, filed Jan. 9, 2003. The entire contents of the above referenced applications are hereby incorporated by reference in their entirety.

The invention relates to a piezoelectric type lighter comprising a flame generation device which comprises a mechanism for releasing a jet of gas and a piezoelectric mechanism for generating a spark.

BACKGROUND OF THE INVENTION

It is known that the use of lighters by unintended users such as children may prove dangerous since, in handling a lighter, they risk igniting a flame and thereby injuring themselves or others, or even causing material damage to their surroundings.

This problem is increasingly taken into account by industrialists who manufacture lighters and, moreover, standards are in course of being drawn up in order to guarantee a certain level of safety of these products in relation to unintended users.

From the document U.S. Pat. No. 5,120,216, a lighter is known which proposes a safety mechanism in order to reduce the risks of lighting such a lighter by children.

The lighter is a friction wheel lighter provided with a pivotable cap which, in its so-called closed position, covers both the friction wheel as well as the region in which a flame is generated and in which a gas jet release nozzle is situated.

The pivoting of the cap by a user causes the friction wheel to rotate by the intermediary of a friction portion provided on the inner part of the cap and thus gives rise to the generation of a spark.

Furthermore, the effect of the pivoting of the cap is also to act on the gas jet release mechanism by means of a rocking lever.

A lighter is also known from the document U.S. Pat. No. 6,186,772, which is provided with a protective cap pivotable about an axis.

An actuator joined to the cap actuates both the gas jet release mechanism and the spark generation mechanism when the assembly formed by the cap and the actuator has pivoted about the aforementioned axis due to a force applied by the user.

That lighter is thus provided with a safety mechanism which prevents its use by children.

The safety mechanisms presented in the above documents are of relatively complicated design, which thereby renders their manufacture difficult.

Moreover, these mechanisms sometimes make it difficult to use these lighters by "authorized" users, such as adults.

SUMMARY OF THE INVENTION

The object of the present invention is to remedy at least one of the aforementioned drawbacks, by providing a piezoelectric type lighter comprising a flame-generation device which comprises a mechanism for releasing a jet of gas and a piezoelectric mechanism for generating a spark, characterized in that the lighter comprises two actuators able to make a pivoting movement under the action of a force applied by a user between a first so-called resting position and a second so-called active position, at least one of said actuators, referred to as the first actuator, being adapted to move independently of the second actuator and to act on at least one of said mechanisms, referred to as the first mechanism, the lighter being adapted to generate a flame externally of the lighter when the two actuators have pivoted.

Thus, in order to operate the lighter according to the invention, the authorized user of the lighter will not have to perform a movement fundamentally different from that performed with conventional lighters for which he applies, using the thumb, a pivoting movement to the cap of the actuator of the lighter by drawing the cap towards himself.

Since both actuators must have pivoted for the lighter to generate a flame externally of the latter, it will be difficult for an unintended user, such as a child who has smaller fingers than those of an adult, to operate the lighter according to the invention by simultaneously pressing on both actuators.

Moreover, given that at least one of the two actuators can move independently of the other actuator, if the child presses on only one of the two actuators, the chances of his being able to operate the lighter according to the invention are one in two, which does after all offer a certain degree of safety which is at least as great as that provided by the safety mechanisms of the prior art.

According to one feature, when it is displaced under the action of a force applied by a user, the second actuator is adapted to drive the first actuator through a pivoting movement along a given path, the two actuators being situated one behind the other on that path.

The arrangement of the two actuators one behind the other on the path along which they must be moved for normal operation of the lighter, renders such operation difficult by a child having small fingers.

Since children often try to imitate adults after having observed them, if a child tries to position the lighter according to the invention as he has seen an adult do, that is to say vertically with the first actuator facing him, the second actuator is then located partly hidden by the first actuator.

In this situation, it is also very likely that the finger of a child will be placed by preference on the first actuator without however going as far as the second actuator and will thus drive only the first actuator in a pivoting movement.

It should be noted that the safety of the lighter according to the invention may furthermore be increased by increasing the force of resistance to the pivoting movement of the second actuator in order that, even if the child manages to press simultaneously on the first and second actuators, the force he will apply will be insufficient also to give rise to the pivoting of the second actuator.

The force a child will apply on pressing simultaneously on the first and second actuators will moreover be badly utilized since, on account of his small fingers, he will not manage to cover the bearing surface of the second actuator as satisfactorily as an adult.

It will also be noted that when a child manages to pivot solely the first actuator without succeeding in moving the second actuator, either because his finger does not cover the bearing surface of the second actuator, or because the force he applied was insufficient, the child may be tempted not to seek to move the second actuator at all costs since he will have seen that he had nevertheless obtained some result in moving the first actuator and thus in reproducing the gestures he had previously seen being made by an adult.

According to one feature, the first actuator is adapted to act on one of the mechanisms, referred to as the first mechanism, and the second actuator is adapted to act on the second mechanism.

In this manner, the safety of the lighter according to the invention is increased since no flame can be generated if only one of the actuators is moved.

According to another feature, at the same longitudinal end of the lighter, each actuator comprises a cap adapted to be subjected to a force applied by a user of the lighter and which is arranged such that the two caps are situated side by side.

According to another feature, the cap of the second actuator, referred to as the second cap, comprises at least one portion which penetrates into a region of the cap of the first actuator, referred to as the first cap, such that a force applied by a user in that region drives the two caps through a pivoting movement.

Thus, as the finger of an adult is sufficiently wide, pressing of this finger on the entirety or nearly the entirety of the first cap will suffice to drive the second cap in the pivoting movement as well.

On the contrary, given the small size of the fingers of a child and the relatively high force which he must apply to cause the caps to pivot and in particular the second cap only by pressing on the penetrating portion of the latter, this feature has the advantage of making it difficult to use the lighter by a child, while facilitating its use by an adult.

This is because the adult will thus not have to position his finger well beyond the first cap to ensure the pivoting of the two caps.

According to still another feature, the penetrating portion of the second cap has a bearing surface which is not smooth.

Thus, this will make it possible to avoid the finger of the user from slipping on that penetrating portion when he seeks to move the two caps.

To improve the adherence and thus the bearing of the user's finger on that penetrating portion, a certain level of roughness may for example be given to that portion by means known to the person skilled in the art.

According to one feature, the two caps have bearing surfaces presented to a user which are arranged at different levels along the longitudinal direction of the lighter, the bearing surface of the second cap being arranged at a level below than that of the bearing surface of the first cap.

This arrangement further increases the difficulty of operating the lighter by a child who will thus find it difficult to correctly position his finger simultaneously on both caps.

This difficulty will be increased when the second cap is situated further away from the child than the first cap.

According to one feature, one of the two actuators, in its resting position, covers a region of the lighter in which a flame is generated externally of the lighter when both mechanisms are activated.

This constitutes an additional safety feature since both the mechanisms of spark generation and of gas jet release must have been activated for a flame to be generated externally of the lighter and since both actuators must have pivoted.

According to one feature, the actuator covering the region of the lighter in which a flame is generated is the second actuator.

According to another feature, the first actuator is adapted to act on both the mechanisms and to generate a flame, the second actuator, in its resting position, covering a region of the lighter in which the flame is generated, thus preventing the latter from propagating externally of the lighter when the second actuator has not pivoted.

Even in this configuration in which one of the two actuators which is adapted to move independently of the other actuator may act on both the mechanisms of spark generation and of gas jet release, the safety of the lighter according to the invention is increased since the other actuator remains in the resting position and covers the region of the lighter in which the flame is generated.

According to another feature, the first mechanism is the spark generation mechanism and the second mechanism is the gas jet release mechanism.

BRIEF DESCRIPTION OF THE DRAWINGS

Other features and advantages will appear in the following description, which is given solely by way of non-limiting example and made with reference to the accompanying drawings, in which.

DETAILED DESCRIPTION OF THE INVENTION

Figure 1:
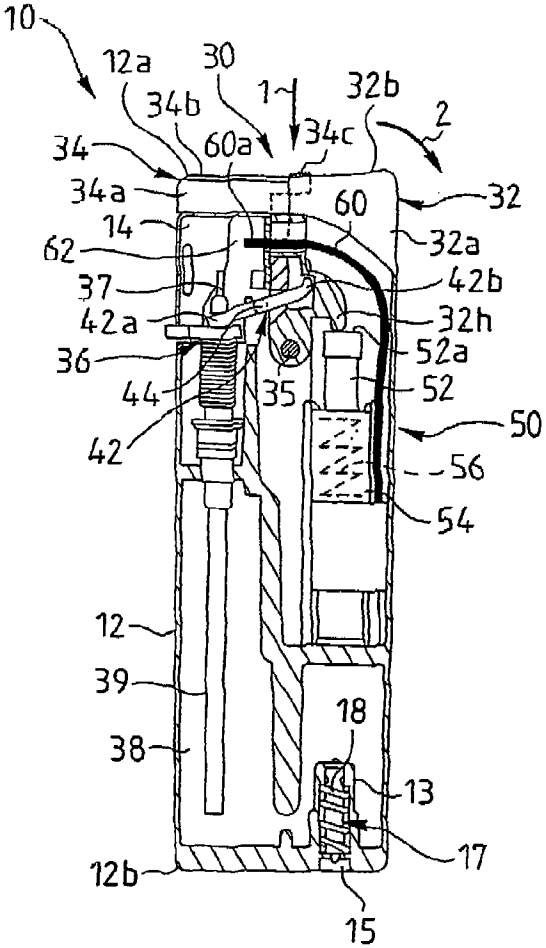
FIG. 1 shows a part section view of a lighter according to the invention.

As shown in FIG. 1 and indicated by the general reference number 10, a lighter according to the invention has a body 12 of elongated general form having two longitudinal ends 12*a*, 12*b*.

The lighter also comprises, at the upper part of the body close to the longitudinal end 12*a*, a part, generally of pierced metal, denoted 14, forming a screen against the wind in order to protect a flame generated in that region by the lighter.

The lighter according to a first embodiment of the invention comprises a flame generation device, denoted 30 in FIG. 1 and which comprises two actuators 32 and 34 shown on the upper portion of the body 12 of the lighter.

Under the action of a force applied by a user, the two actuators are each capable of moving along a path, which may, for example, be circular.

The two actuators are rotatably mounted about the same horizontal axis 35.

Figure 6:
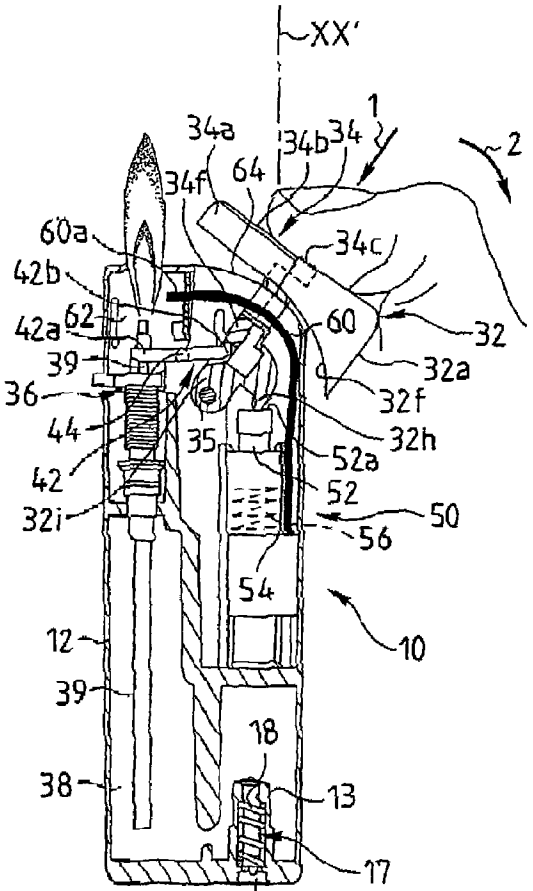
FIG. 6 shows the operation of the lighter according to the invention by an authorized user such as an adult.

They then make a pivoting movement about that axis 35 perpendicular to the plane in which the path is included, between a so-called resting position (FIG. 1) and a so-called active position (FIG. 6).

Figure 5:
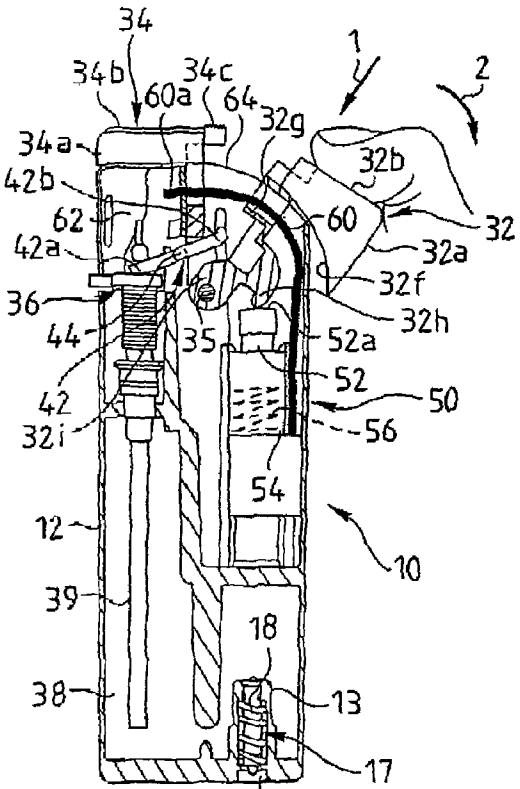
FIG. 5 is a part section view similar to that of FIG. 1, showing the use of the lighter according to the invention by an unauthorized user.

In FIG. 5, solely the first actuator 32 is in an active position.

The two actuators 32 and 34 respectively comprise, at the longitudinal end 12*a*, a cap referred to as the first cap 32*a* and a cap referred to as the second cap 34*a*.

The two caps are arranged side by side and, more particularly, are situated one behind the other when considering the path they follow in their pivoting movement, the first cap 32*a* moving first in that path.

Each cap has an upper bearing surface also referred to as a contact surface which is presented to an authorized user (adult) of the lighter in order to for him to place a finger there and to apply thereon a force as indicated by the arrows having references 1 and 2 on FIGS. 1, 5 and 6.

In the embodiment illustrated in FIGS. 1 to 6, the respective bearing surfaces 32*b*, 34*b* of the two caps 32, 34 are arranged at the same level in the longitudinal direction (height) of the lighter.

Figure 3:
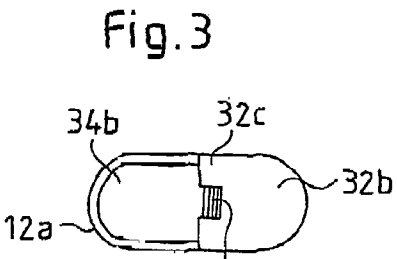
FIG. 3 shows a view from above of the lighter shown in FIGS. 1 and 2.
Figure 4:
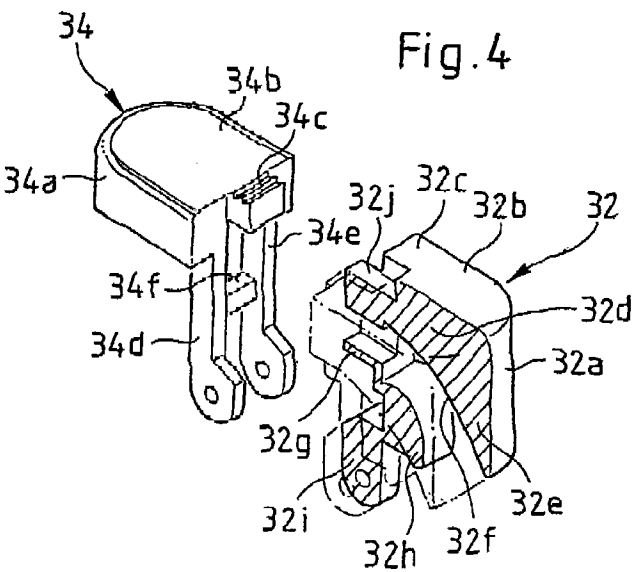
FIG. 4 is a perspective view of the two actuators 32 and 34 of the lighter of FIGS. 1 to 3, the actuator 32 being shown in part section in that Figure.
Figure 2:
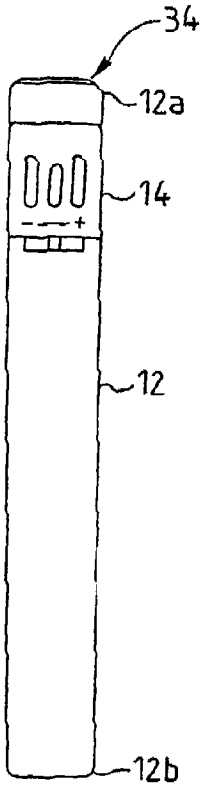
FIG. 2 shows a side view of the lighter of FIG. 1, seen from the outside.

As shown in FIGS. 3 and 4, the second cap 34*a* comprises at least one portion 34*c* which penetrates into a region 32*c* of the first cap 32*a*.

The penetrating portion 34*c* has, for example, a bearing surface which is not smooth in order to facilitate the pressing of a finger of an authorized user. For this, the upper bearing surface of that portion 34*c* is granted a given level of roughness.

For example, it may be provided to form a plurality of grooves or striations substantially parallel to each other and parallel to the horizontal axis 35 about which the actuators 32 and 34 pivot.

As will be seen in what follows, this non smooth bearing surface makes it possible to establish a non-slip contact between the finger of an authorized user and thereby pivot both caps and thus both actuators simultaneously when the finger is placed on the region 32*c* and a force applied in the direction of the arrows 1 and 2 of FIGS. 1 and 6.

The penetrating portion 34*c* may also be smooth, which will require the user of the lighter to apply a greater force to cause the second cap 34*a* to rotate. In such a case, portion 34*c* may be slightly enlarged to facilitate use of the lighter by an adult user.

It will be noted that in the position of normal use, the lighter is placed in a vertical position as shown in the drawings and such that the first cap faces the user's finger (to the right in FIGS. 5 and 6), the second cap being situated behind the first cap.

The flame generation device 30 also comprises a mechanism 36 for releasing a jet of gas 36.

The gas jet release mechanism includes a gas jet release member, denoted 37, which for example is in the form of a nozzle connected to a gas-filled reservoir in a manner known to the person skilled in the art.

The mechanism 36 also comprises a part 42 represented in FIGS. 1, 5 and 6 which is pivotable about an axis 44 parallel to the pivotal axis 35 of the actuators, perpendicularly to the longitudinal direction of the lighter.

Part 42 forms a lever and comprises in known manner, at one of its ends, two arms (of which only 42*a* is represented in the drawings) clasping a pipe 39 (FIG. 6) of which one end is situated under the valve of the nozzle and brings the gas to the latter, the opposite end being arranged in the reservoir 38. The lever forming part 42 also comprises at its opposite end a leg 42*b* which is adapted to cooperate as will be seen later with one of the two actuators.

When this cooperation has taken place part 42 pivots about its axis 44, which allows it to raise the valve of the nozzle 37 and thus to release a jet of gas (FIG. 6).

As represented in FIGS. 1, 5 and 6, the lighter 10 according to the invention comprises, at the lower portion at the end 12*b*, a formation 13 projecting into the body 12 in order to enable the user to refill the lighter with gas.

This formation comprises, more particularly, starting with the end 12*b*, an orifice 15 opening to the outside and a non-return valve 17 constituted by, for example, a ball, not shown in the drawings, held in position by a spring in tension.

When the user wishes to refill his lighter with gas, he then puts into the orifice 15 which opens at the end 12*b* of the lighter a refilling device which make it possible to release the tension of the spring and thus to separate the ball from the seating of the valve 17.

The flame-generation device 30 also includes a piezoelectric spark generation mechanism, denoted 50.

This mechanism 50, known to the person skilled in the art, is in the form of a member 52 which is substantially cylindrical overall (FIG. 1) and which slides within a cylindrical sleeve 54 within which there is, in particular, a spring 56. The spring exerts an upwards force so as to keep the member 52 in raised position when no force along the arrow 2 is exerted by the user on the actuators or at least on the first actuator 32.

The lighter operates in accordance with the known principle of the piezoelectric effect, according to which a piezoelectric element (not shown), such as a crystal, placed at the bottom of the sleeve 54, is struck by an member forming a hammer in order to produce an electric spark.

The end (not shown in the Figures) of the cylindrical member 52 which is opposite the end 52*a* which is seen in FIGS. 1, 5 and 6 and which is in contact with the first actuator 32, serves as a hammer to strike the aforementioned piezoelectric element when said cylindrical member 52 is moved downwardly, along axis XX', under the action of a force applied by the finger of a user on at least the first actuator 32.

The device 30 also comprises an electrical conductor 60 by which a spark produced by the above-mentioned piezoelectric mechanism is propagated.

The electrical conductor 60 is electrically connected in known manner to the aforementioned mechanism by one of its ends located in the lower part of the drawing of FIGS. 1, 5 and 6, but not shown.

The conductor 60 emerges at its opposite end 60*a* (FIGS. 1, 5 and 6) into what is referred to as a combustion chamber 62 provided within the part forming a screen 14 and into which the aforementioned gas release member 37 also opens.

In the position shown in FIG. 5, the device 30 is not activated to generate a flame since only the spark generation mechanism 50 has been activated.

In the position shown in FIG. 6, the device 30 is activated to generate a flame since, as will be seen later, both the aforementioned mechanisms 36 and 50 have been activated.

As shown in FIG. 4, the cap 32*a* of the first actuator 32 is in the general form of a right-angled bracket having a first horizontal portion 32*d* of which the upper surface corresponds to the bearing surface 32*b* already mentioned above.

A second vertical portion 32*e* extends downwardly from that horizontal portion, thus giving the combination of the two portions the form of a right-angled bracket.

The horizontal and vertical portions join together by an inner wall 32*f* of curved form.

It will be noted that this curved form follows the corresponding curved form 64 of the lighter represented in FIG. 5, thus making it possible to ensure the guiding of the first actuator in its pivotal movement about the horizontal axis 35.

The first actuator 32 also comprises a vertical extension from the horizontal portion 32*d*, which is opposite the vertical portion 32*e*.

This vertical extension is directed downwardly from the region 32*c* of the cap to form firstly a central hollow portion 32*g* allowing the electrical conductor 60, not shown on FIG. 4, to pass through.

This central portion 32*g* then continues offset from the vertical axis towards the vertical portion 32*e* of the cap, so as to form a beak 32*h* which is downwardly curved so as to cooperate with the upper surface of the end 52*a* of the cylindrical member 52, as shown in FIGS. 5 and 6.

From this beak 32*h*, the extension of the first actuator continues downwardly, in a manner offset from the vertical direction, as a portion 32*i* which will serve as a bearing to receive the axis 35 about which the cap 32 pivots.

In the region 32*c* of the cap 32*a* a recess 32*j* is provided which enables the penetrating portion 34*c* of the second cap 34*a* to be received.

To better understand the structure of the first actuator 32, the latter has been represented in part section, the portion of the member in section being indicated by fine hatched lines.

As for the second actuator 34, this comprises the second cap 34*a* which has a generally parallelepiped form rounded at one of its ends which is visible from outside the lighter, the opposite end being adapted to cooperate with the first actuator.

The second actuator also comprises a vertical extension from the first horizontal cap 34*a*, which is formed of two mutually parallel legs 34*d*, 34*e* joined by a horizontal transverse bar 34*f* which ensures the rigidity of the whole.

Moreover, as will be seen later, this bar 34*f* also enables cooperation with the leg 42*b* of the lever 42, in order to activate the gas jet release mechanism.

Furthermore, the two legs 34*d* and 34*e* are each pierced through their thickness, at their free end, opposite each other, by a hole adapted to receive the axis 35 about which the second actuator 34 is made to pivot.

When the gas jet release mechanism is activated and the spark generation mechanism is also activated, the nozzle 37 is located in raised position close to the emerging end 60*a* of the electrical conductor 60 at which the spark is generated and said nozzle releases a jet of gas, thus enabling a flame to be generated in the region of the lighter surrounded by the screen 14 (FIG. 6).

In its resting position (FIGS. 1 and 5), the second actuator 34 covers the combustion chamber 62.

For a flame to be generated and to propagate externally of the lighter, the two actuators must have pivoted as represented in FIG. 6 and be located in their active position.

In accordance with the invention, at least one of said actuators, i.e. the first actuator, is adapted to move independently of the second actuator and to act on at least one of the two mechanisms which are the gas jet release mechanism 36 and the piezoelectric spark generation mechanism 50

More particularly, the first actuator 32 is adapted to act on the first spark generation mechanism in the embodiment represented in the drawings. As for the second actuator 34, this is adapted to act on the second mechanism 36, which is for releasing a jet of gas.

As already mentioned above, in order for the lighter according to the invention to be able to generate a flame externally of itself, it is necessary for the two actuators, and in particular for the two caps of said actuators, to have pivoted about the axis 35 from their resting position represented in FIG. 1, to their active position, represented in FIG. 6.

For this, a force must be applied by the finger of an authorized user (adult) in the directions shown by arrows 1 and 2 of FIGS. 1 and 6.

It will be noted that when the finger of an unauthorized user is positioned as shown in FIG. 5, that is to say that it bears only on the first cap 32*a* of the first actuator 32, it can then only make the first actuator pivot in the direction indicated by the arrow 2 about the horizontal axis 35.

In this manner, an unauthorized user, such as a child, causes the activation of spark generation mechanism 50 by cooperation of the beak 32*h* of the first actuator with the bearing surface 52*a* of the cylindrical member 52.

In that case, only the mechanism 50 is activated since the finger of the child is incorrectly positioned (FIG. 5) and is, in any case, too small to be correctly positioned.

Even if the finger of that child were to be positioned above the penetrating portion 34*c* of the second cap, the force which would be needed to be applied in the direction indicated by the arrow 1 (FIG. 4) on that part 34*c* of small dimensions to drive that cap in a pivotal movement too, would be too great for a child.

This thus represents an additional safety feature for the lighter according to the invention.

It should also be noted that, in another embodiment not shown in the drawings, the penetrating portion 34*c* of the second cap could be omitted and, in that case, the authorized user must move his finger further forward in order to cover practically the whole of the two bearing surfaces 32*b* and 34*b* of the two caps and apply an even greater pressure force in direction 1 of FIG. 4.

Nevertheless, the embodiment shown in FIGS. 1 to 6 represents a good compromise between the difficulty of operation of the lighter according to the invention for an unauthorized user and the ease with which an authorized user must be able to operate the lighter.

According to a variant of the invention not shown in the drawings, the first actuator 32 may also be adapted to act on the two mechanisms 36 for release of a jet of gas and 50 for spark generation, if a few structural modifications are made which are within the capability of the person skilled in the art.

More particularly, it is thus appropriate for the beak forming portion 32*h* of the first actuator to be formed differently by providing, for example, a hook form opposite the beak, in order to actuate the leg 42*b* of the lever 42 and so release a jet of gas when the first actuator alone moves.

According to this variant, solely the movement of the first actuator 32 suffices to activate both of the aforementioned mechanisms and thus to generate a flame.

However, with the second cap 34*a* of the second actuator 34 remaining in its resting position and thereby covering the region of the lighter (combustion chamber 62) in which the flame is generated, the flame cannot propagate externally of the lighter and thereby risk causing accidents, or even inflicting injury on certain persons, such as to the child who may have used the lighter.

Returning to the embodiment of FIGS. 1 to 6, the finger of an adult is sufficiently large to be able to be correctly positioned, as shown in FIG. 6, that is to say to cover at the same time at least a part of the bearing surface 32*b* of the first cap and the bearing surface of the penetrating portion 34*c* of the second cap.

Furthermore, an adult is capable of exerting a force sufficient to apply a pressure perpendicular to the aforementioned bearing surfaces (arrow 1) and, in particular that of the penetrating portion 34*c* (direction also perpendicular to the pivotal axis 35 of the two actuators), to simultaneously drive the two actuators 32 and 34 in a pivotal movement about the axis 35, following the arrow denoted 2.

As already indicated above, it will be noted that the penetrating portion 34*c* may either be smooth, or be omitted.

If that portion is omitted, the authorized user must position his finger beyond the bearing surface 32*b* of the first cap, so as to cover in addition the bearing surface 34*b* of the second cap practically entirely.

It should also be noted that it suffices for the authorized user to position his finger on the second cap 34*a*, and to simultaneously apply a force vertically downwards, in the direction indicated by the arrow 1, and a pivotal movement, in the direction indicated by the arrow 2, since such a pivotal movement of the second actuator will induce the pivoting of the first actuator which is in contact with it, the two actuators being placed one behind the other on the same path.

As shown in FIG. 6, when the second actuator 34 is driven in a pivotal movement, then the central horizontal bar 34*f* of the second actuator enters into contact with the raised end of the leg 42*b* of the lever 42 and thus drives the latter into a pivotal movement about its axis 44, the effect of which is to release a jet of gas as already described earlier.

Simultaneously, the first actuator, via its beak, activates the spark generation mechanism at the end 60*a* of the conductor 60, the effect of which is to generate a flame in the region surrounded by the screen 14.

Since the second actuator 34 is moved from its resting position and thus no longer covers the region in which the flame is generated, the flame may propagate outside the combustion chamber externally of the lighter, as represented in FIG. 6.

It will be noted that in the embodiment represented in the drawings, solely an elastic means, such as the spring 56 in FIG. 1, opposes the pivotal movement of the first actuator 32.

However, according to a variant not shown, a second elastic means may be provided in order to oppose the pivotal movement of the second actuator 34.

Provision may for example be made for a spring mounted on the pivotal axis 35, of which a portion would be in contact with an abutment, whereas the other portion would be in contact with the second actuator.

In this variant, the user must exert a sufficient additional force to drive the second actuator in a pivotal movement, which here again represents an additional safety feature with respect to unauthorized users.

According to still another variant, the compressive force of the spring 56 is set at a value below that of the compressive force of the spring opposing the pivotal movement of the second actuator, in order to give additional safety to the lighter made in this way.

Generally, it should be noted that when the user ceases to exert a force on the first actuator 32 in the direction indicated by the arrow 2, the relaxation of the spring 56 returns the first actuator to its resting position represented in FIG. 1.

Figure 7:
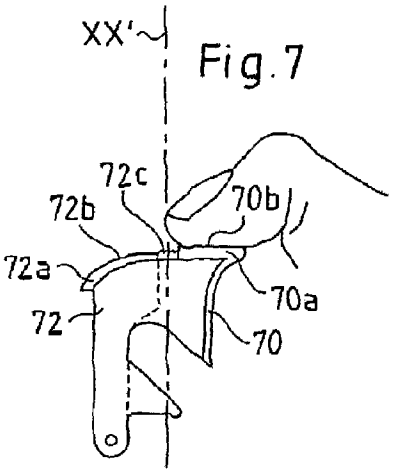
FIG. 7 shows a variant embodiment of a particular arrangement of the two actuators of the lighter according to the invention.
Figure 8:
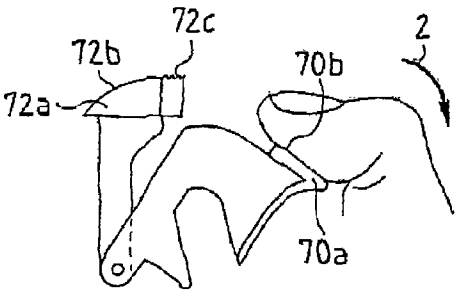
FIG. 8 shows the operation of such actuators by an unauthorized user.

According to a variant illustrated in FIGS. 7 and 8, the two caps 70*a* and 72*a* of the two actuators 70 and 72 have respective bearing surfaces 70*b* and 72*b* for the user which are provided at different levels along the longitudinal axis XX' of the lighter.

The second cap also comprises a penetrating portion 72*c* like the portion 34*c* of the preceding Figures.

This feature makes it possible to increase the safety of the lighter with respect to unintended users such as children, since in this variant the most visible and accessible part of the lighter is the bearing surface of the first actuator.

This is particularly the case when the lighter is in the position in which a user knowing how to use the lighter would hold it to generate a flame, i.e. with the first actuator facing the user and the second actuator at the back.

As shown in FIGS. 7 and 8, the finger of an unauthorized user will have a preferential tendency to reach the bearing surface 70*b* of the first cap 70*a*, which will then cause solely pivoting of the first actuator 70 when the user exerts a force in the direction of the arrow 2.

The arrangement of the second cap of the second actuator at a lower level than that of the first cap of the first actuator thus make it possible to make the second actuator less easily accessible to an unauthorized user.

This is also explained by the fact that a typical unauthorized user such as a child has smaller fingers than those of an adult.

As for the authorized user, such as an adult, he will position his finger, which will generally be his thumb, also on at least a portion of the bearing surface 72*b* of the second cap 72*a* and, by exerting a force in the direction of the arrows 1 and 2 of FIG. 1, will thereby manage to drive the two actuators in a pivotal movement and thus operate the lighter according to the invention.

This will be all the easier for the authorized user having larger fingers and greater muscular force than a child.

The invention claimed is:

1. A piezoelectric lighter comprising:

a flame-generation device comprising a first mechanism for releasing a jet of gas, and a piezoelectric mechanism for generating a spark;

a first and second actuator, each pivotably movable, at least one of said first and second actuator being adapted to pivotably move independently of the pivoting motion of the other actuator;

at least one of said first and second actuator capable of acting on one or both mechanisms;

wherein the first and second actuator, the gas release jet mechanism, and the piezoelectric mechanism are interconnected so that the piezoelectric mechanism produces a flame external to the lighter only upon the pivotable motion of both the first and second actuator.

2. The lighter according to claim 1, wherein the second actuator is configured to, upon being displaced under the action of the force applied by the user, drive the first actuator through a pivoting movement along a given path, the first and second actuators being situated one behind the other on said given path.

3. The lighter according to claim 1, wherein each of said first and second actuators comprise a cap at a longitudinal end of said lighter configured to be subjected to the force applied by said user and arranged such that the two caps are situated side by side.

4. The lighter according to claim 3, wherein the cap of the second actuator comprises at least one portion which penetrates into a region of the cap of the first actuator such that the force applied by said user in the region drives the two caps through the pivoting movement.

5. The lighter according to claim 4, wherein the penetrating portion of the cap of the second actuator has a bearing surface which is not smooth.

6. A piezoelectric lighter, comprising:

a flame-generation device comprised of a first mechanism for releasing a jet of gas and a piezoelectric second mechanism configured to generate a spark; and two actuators, wherein at least a first of said two actuators is configured to move independently of a second of said two actuators, wherein said first actuator is configured to make only a pivoting movement responsive to a force applied by a user between a first resting position and a second active position in which said first actuator is adapted to act on at least said first of said first and said second mechanisms, wherein said second actuator is configured to make only the pivoting movement responsive to the force applied by said user between the first resting position and the second active position in which said second actuator is adapted to act on said second mechanism, wherein each of said first and second actuators comprise a cap at a longitudinal end of said lighter configured to be subjected to the force applied by said user and arranged such that the two caps are situated side by side, wherein the two caps have bearing surfaces presented to said user arranged at different levels along a longitudinal direction of the lighter, a second bearing surface of the second cap being arranged at a second level below a first level of a first bearing surface of the first cap, and wherein said flame-generation device is configured to generate a flame externally of the lighter upon a pivoting of said first and second actuators.

7. The lighter according to claim 6, wherein the second actuator is configured to, upon being displaced under the action of a force applied by the user, drive the first actuator through a pivoting movement along a given path, the first and second actuator being situated one behind the other on said given path.

8. A piezoelectric lighter, comprising:

a flame-generation device comprised of a first mechanism for releasing a jet of gas and a piezoelectric second mechanism configured to generate a spark; and two actuators, wherein at least a first of said two actuators is configured to move independently of a second of said two actuator, wherein said first actuator is configured to make only a pivoting movement responsive to a force applied by a user between a first resting position and a second active position in which said first actuator is adapted to act on at least said first of said first and said second mechanisms, wherein said second actuator is configured to make only the pivoting movement responsive to the force applied by said user between the first resting position and the second active position in which said second actuator is adapted to act on said second mechanism, wherein said flame-generation device is configured to generate a flame externally of the lighter upon a pivoting of said first and second actuators, and wherein said second actuator, when in the first resting position, covers a region of the lighter in which the flame is generated when both mechanisms are activated.

9. The lighter according to claim 8, wherein the second actuator is configured to, upon being displaced under the action of the force applied by the user, drive the first actuator through a pivoting movement along a given path, the first and second actuators being situated one behind the other on said given path.

10. The lighter according to claim 8, wherein each of said first and second actuators comprise a cap at a longitudinal end of said lighter configured to be subjected to the force applied by said user and arranged such that the two caps are situated side by side.

11. The lighter according to claim 10, wherein the cap of the second actuator comprises at least one portion which penetrates into a region of the cap of the first actuator such that the force applied by said user in the region drives the two caps through the pivoting movement.

12. The lighter according to claim 11, wherein the penetrating portion of the cap of the second actuator has a bearing surface which is not smooth.

13. A piezoelectric lighter, comprising:

a flame-generation device comprised of a first mechanism for releasing a jet of gas and a piezoelectric second mechanism configured to generate a spark; and two actuators, wherein at least a first of said two actuators is configured to move independently of a second of said two actuators, wherein said first actuator is configured to make only a pivoting movement responsive to a force applied by a user between a first resting position and a second active position in which said first actuator is adapted to act on at least said first of said first and said second mechanisms, wherein said second actuator is configured to make only the pivoting movement responsive to the force applied by said user between the first resting position and the second active position in which said second actuator is adapted to act on said second mechanism, wherein said flame-generation device is configured to generate a flame externally of the lighter upon a pivoting of said first and second actuators, and wherein the first actuator is adapted to act on both said first and second mechanisms to generate a flame, and the second actuator, in the first resting position, covers a region of the lighter in which the flame is generated, thus preventing the flame from propagating externally of the lighter when the second actuator has not pivoted.

14. The lighter according to claim 13, wherein the second actuator is configured to, upon being displaced under the action of the force applied by the user, drive the first actuator through a pivoting movement along a given path, the first and second actuators being situated one behind the other on said given path.

15. The lighter according to claim 13, wherein each of said first and second actuators comprise a cap at a longitudinal end of said lighter configured to be subjected to the force applied by said user and arranged such that the two caps are situated side by side.

16. The lighter according to claim 15, wherein the cap of the second actuator comprises at least one portion which penetrates into a region of the cap of the first actuator such that the force applied by said user in the region drives the two caps through the pivoting movement.

17. The lighter according to claim 16, wherein the penetrating portion of the cap of the second actuator has a bearing surface which is not smooth.

* * * * *

UNITED STATES PATENT AND TRADEMARK OFFICE

CERTIFICATE OF CORRECTION

PATENT NO. : 7,641,471 B2
APPLICATION NO. : 10/541674
DATED : January 5, 2010
INVENTOR(S) : Aman Kai Man Chung It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 909 days.

Signed and Sealed this

Twenty-first Day of December, 2010

David J. Kappos

David J. Kappos
*Director of the United States Patent and Trademark Office*